United States Patent [19]

Beagley

[11] Patent Number: 4,841,576

[45] Date of Patent: Jun. 27, 1989

[54] DEVICE FOR ATTACHING A RETAINING STRING TO HEADWEAR

[75] Inventor: Jerry D. Beagley, Calera, Okla.

[73] Assignee: Jerry Beagley Braiding Co., Inc., Calera, Okla.

[21] Appl. No.: 167,403

[22] Filed: Mar. 14, 1988

[51] Int. Cl.[4] ..... A42B 7/00

[52] U.S. Cl. ..... 2/189; 2/421; 132/58

[58] Field of Search ..... 2/189, 188, 185 R, 199, 2/421; 132/58, 59

[56] References Cited

U.S. PATENT DOCUMENTS

| | | | |
|---|---|---|---|
| 393,595 | 11/1888 | Veatch | 132/58 |
| 1,406,622 | 2/1922 | Donlin | 2/189 |
| 1,419,325 | 6/1922 | Storm | 132/58 |
| 2,343,052 | 2/1944 | Gifford | 132/58 |

*Primary Examiner*—Peter Nerbun

*Attorney, Agent, or Firm*—W. Kirk McCord

[57] ABSTRACT

A device for attaching a retaining string to headwear is comprised of first, second and third relatively flat tab members, which are substantially co-planar. The first and second tab members are oriented along a common axis, while the third tab member is oriented along an axis which is substantially orthogonal with respect to the common axis of the first and second tab members to define a substantially T-shaped device. The transition between the third tab member and each of the first and second tab members defines a corresponding curved edge. To attach the retaining string, the third tab member is inserted between the crown portion of the headwear and the flexible band on the inside of the crown portion and down through the stitches which attach the band to the crown portion. The first and second tab members engage the stitches to retain the device in position behind the band. The distal portion of the third tab member extends below the band and is adapted to be attached to one end of the retaining string. A pair of devices is used to attach a pair of retaining strings to the headwear to provide a conventional "stampede" string configuration.

20 Claims, 1 Drawing Sheet

DEVICE FOR ATTACHING A RETAINING STRING TO HEADWEAR

FIELD OF THE INVENTION

The present invention relates to headwear and in particular to a device for attaching a "stampede" string or the like to headwear.

BACKGROUND OF THE INVENTION

Headwear, such as Western hats, English hats and the like, is often worn by persons engaged in outdoor work, horseback riding and other outdoor activities. When engaged in these outdoor activities, it is common for a user to secure his headwear by means of a "stampede" string or the like.

DESCRIPTION OF THE PRIOR ART

According to prior practice, such stampede strings are usually attached to the hat by running the free ends of the string through oppositely positioned holes in the brim of the hat adjacent to the crown portion of the hat and either wrapping a portion of the string at least partially around the crown portion of the hat or tying a knot on the top side of each hole. An adjustment member such as a ring or a clip joins the free portions of the string together. The adjustment member is usually pulled up tight under the wearer's chin to exert tension on the string and keep the hat tightly in place on the user's head.

One problem associated with such prior art strings is that holes must be formed in the brim of the hat to allow the strings to pass through the hat and be fastened around the user's head and under his chin. These holes not only deface the hat, but are also unsightly, particularly when the stampede string is not being used and the holes are clearly visible. The holes also allow water to seep through the brim when the hat is worn in inclement weather.

OBJECTS OF THE INVENTION

It is, therefore, the principal object of the present invention to provide an improved device for attaching a retaining string or the like to headwear.

Another object of the invention is to provide a device for attaching a retaining string to headwear without altering the appearance of the headwear.

Still another object of the invention is to provide a device for attaching a retaining string to headwear, which can be quickly and conveniently secured to and detached from the headwear without defacing it.

SUMMARY OF THE INVENTION

These and other objects are accomplished in accordance with the present invention wherein a device for attaching a retaining string or the like to headwear, having a crown portion for receiving the user's head, a flexible band around the inside of the crown portion for contacting user's head and a brim portion surrounding the crown portion, is provided. The device is comprised of first means for engaging the band to secure the device relative to the crown portion and second means connected to the first means for being coupled to the retaining string to attach the retaining string to the crown portion of the headwear.

In one embodiment the first means is comprised of first and second relatively flat tab members which are oriented along a common axis and the second means is comprised of a third relatively flat tab member which is oriented along an axis substantially orthogonal relative to the common axis of the first and second tab members. In another embodiment the band is attached to the crown portion by a plurality of stitches spaced at predetermined intervals around the inside of the crown portion and the third tab member is adapted for being inserted between adjacent ones of the stitches so that the third tab members disposed between the band and the inside of the crown portion and a portion of the third tab member extends below the band. The first and second tab members engage adjacent ones of the stitches to prevent the device from being disengaged from between the band and crown portion by movement along the axis of the third tab member in a direction toward the exterior of the crown portion.

In the preferred embodiment the portion of the third tab member which extends below the band is disposed distally with respect to the first and second tab members and is adapted for being coupled to one end of the retaining string. The coupling between the retaining string and the extension portion of the third tab member prevents the device from being disengaged from between the band and the inside of the crown portion by movement along the axis of the third tab member in a direction toward the interior of the crown portion. The extension portion preferably has an opening therein for receiving a clip member or the like attached to one end of the retaining string to couple the retaining string to the device. The first, second and third tab members are preferably substantially co-planar and the third tab member is substantially centrally located relative to the first and second tab members to define a substantially T-shaped device. The corresponding transition between the third tab member and each of the first and second tab members defines a corresponding curved edge.

BRIEF DESCRIPTION OF THE DRAWINGS

Other objects and advantages of the invention will be apparent from the detailed description and claims when read in conjunction with the accompanying drawings wherein:

DETAILED DESCRIPTION OF THE PREFERRED EMBODIMENT

In the description which follows, like parts are marked throughout the specification and drawings, respectively. The drawings are not necessarily to scale and in some instances proportions have been exaggerated in order to more clearly depict certain features of the invention.

Figure 1:
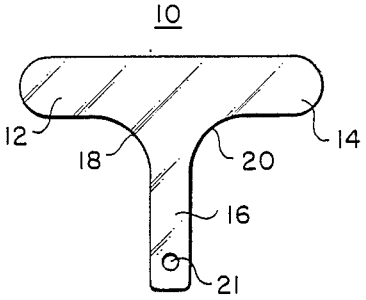
FIG. 1 is an elevation view of a device for attaching a retaining string to headwear in accordance with the present invention.

Referring to FIG. 1, a device 10 for attaching a retaining string or the like to headwear is comprised of first and second relatively flat tab members 12 and 14 which are oriented along a common axis and a third relatively flat tab member 16 which is oriented along an axis substantially orthogonal relative to the common axis of first and second tab members 12 and 14. First, second and third tab members 12, 14, and 16 are substantially coplanar and third tab members 16 is substantially centrally located relative to first and second tab members 12 and 14 to define a substantially T-shaped device 10. The corresponding transitions between third tab member 16 and first and second tab members 12 and 14 define respective curved edges 18 and 20 to enhance the structural integrity of device 10.

Figure 2:
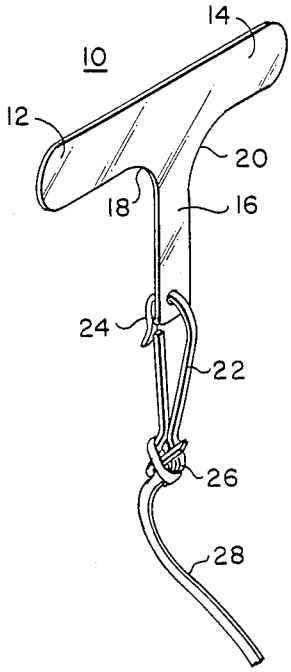
FIG. 2 is a perspective view of the device, illustrating the attachment of the device to one end of the retaining string in accordance with the present invention.
Figure 3:
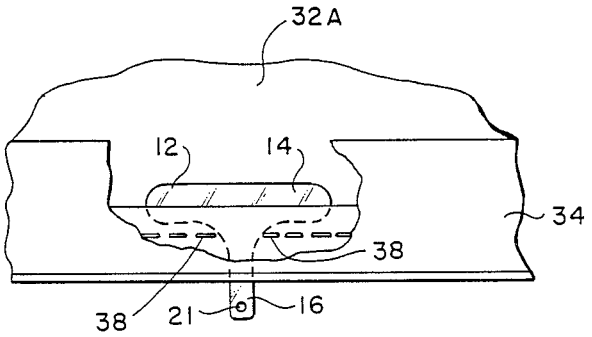
FIG. 3 is a partial cutaway sectional view of a portion of a hat, showing the device positioned between the band of the hat and the inside of the crown portion of the hat in accordance with the present invention.

Referring also to FIGS. 2 and 3, the end portion of third tab member 16 which is distally disposed with respect to first and second tab members 12 and 14 includes a relatively circular opening 21 therein for receiving a portion of a spring clip 22 therethrough. End portion 24 of spring clip 22 extends through opening 21, as best seen in FIG. 2 and the opposite end portion 26 of spring clip 22 is attached to one end of a retaining string 28 (e.g., a "stampede" string), so that retaining string 28 is connected to device 10 by means of spring clip 22.

Figure 4:
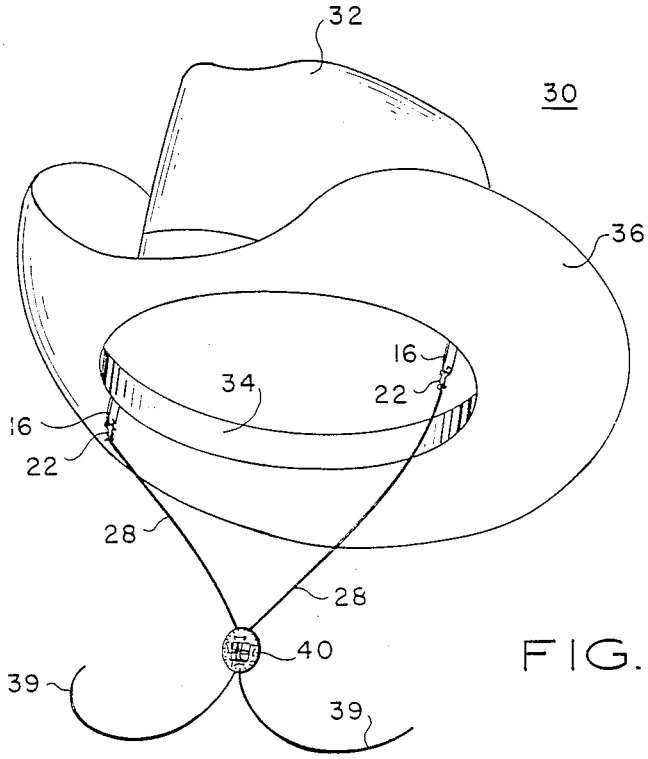
FIG. 4 is a perspective view of a Western hat with a retaining string attached thereto by means of a device according to the present invention.

Before spring clip 22 and retaining string 28 are connected to device 10, device 10 is first secured to the user's headwear, as best shown in FIG. 3. Referring also to FIG. 4, the typical Western hat 30 includes a central crown portion 32 for receiving the user's head, a flexible sweat band 34 around the inside of the crown portion 32 for contacting the user's head when hat 30 is being worn and a brim portion 36 surrounding crown portion 32. Third tab member 16 is adapted for being inserted between adjacent stitches 38, which attach sweat band 34 to inside portion 32A of crown portion 32. Thus, device 10 is disposed between band 34 and inside surface 32A of crown portion 32. Device 10 is inserted downwardly from inside crown portion 32 so that a portion of third tab member 16 extends below band 34, as best seen in FIGS. 3 and 4. First and second tab members 12 and 14 engage stitches 38 to limit the movement of device 10 along the axis of third tab member 16 in a direction toward the exterior of crown portion 32, as indicated in FIG. 3. Until spring clip 22 is attached to third tab member 16, device 10 may be disengaged from between band 34 and inside surface 32A by moving device 10 along the axis of third tab member 16 in a direction toward the interior of crown portion 32. To facilitate the connection of spring clip 22, opening 21 extends below band 34. After one end of retaining string 28 is attached to spring clip 22, curved end 24 of spring clip 22 is passed through opening 21 to connect retaining string 28 to device 10. When this connection is made, device 10 cannot be disengaged from its position between band 34 and inside surface 32A of crown portion 32 by moving device 10 in either direction along the axis of third tab member 16.

To properly retain hat 30 on the user's head, a pair of devices 10, a pair of spring clips 22 and a pair of retaining strings 28 must be used. As best seen in FIGURE 4, two devices 10 are positioned diametrically opposite to one another and the pair of retaining strings 28 are attached to respective devices 10. Respective free ends 39 of retaining strings 28 are passed through an adjustment member 40, which is cinched up under the user's chin to secure hat 30 in place on the user's head. To disengage devices 10 from hat 30, one need only detach the corresponding spring clips 22 and manually move devices 10 upwardly in a direction toward the interior of crown portion 32 so that the respective third tab members 16 are moved from between the corresponding adjacent stitches 38.

In accordance with the present invention, a retaining string, such as a "stampede" string, can be quickly and conveniently attached to and detached from headwear without having to alter the appearance of the headwear. The device allows the stampede string to be wrapped around the user's head and chin so as not to be visible from on top of the hat because no portion of the stampede string is disposed on the outside of the hat brim. Because the major portion of the device is tucked behind the sweat band, the device is unobtrusive and does not detract from either the appearance or the comfort of the hat.

One skilled in the art will appreciate that devices for attaching a retainer string to headwear may take various forms and sizes. For example, in an alternate embodiment, the device may overlap the inside of the sweat band, such that a portion of the device is inside the band and another portion is outside the band in order to secure the device to the headwear.

Various embodiments of the invention have now been described in detail. Since changes in and modifications to the above-described preferred embodiment may be made without departing from the nature, spirit and scope of the invention, the invention is not to be limited to said details, except as set forth in the appended claims.

What is claimed is:

1. A device for attaching a retaining string or the like to headwear having a crown portion for receiving the user's head, a flexible band around the inside of the crown portion for contacting the user's head and a brim portion surrounding the crown portion, said band being attached to the crown portion by a plurality of stitches spaced at predetermined intervals around the inside of the crown portion, said device being comprised of first means for engaging the band to secure the device relative to the crown portion and second means connected to the first means for being coupled to said retaining string or the like to attach said retaining string or the like to the crown portion of said headwear, said second means for being inserted between adjacent ones of said stitches so that a portion of said second means which is distally disposed relative to said first means extends below said band.

2. The device according to claim 1 wherein said first means is comprised of first and second relatively flat tab members which are oriented along a common axis and said second means is comprised of a third relatively flat tab member, which is oriented along an axis substantially orthogonal relative to said common axis of said first and second tab members.

3. The device according to claim 2 wherein said third tab member is adapted for being inserted between adjacent ones of said stitches so that said third tab member is disposed between said band and the inside of said crown portion and a portion of said third tab member extends below said band.

4. The device according to claim 3 wherein said first and second tab members engage said adjacent ones of said stitches to prevent said device from being disengaged from between said band and said crown portion by movement along the axis of said third tab member in a direction toward the exterior of said crown portion.

5. The device according to claim 4 wherein the extension portion of said third tab member is disposed distally with respect to said first and second tab members and is adapted for being coupled to one end of said retaining string or the like, the coupling between said retaining string or the like and said extension portion of said third tab member for preventing said device from being disengaged from between said band and said crown portion by movement along the axis of the third tab member in a direction toward the interior of said crown portion.

6. The device according to claim 5 wherein said extension portion has an opening therein for receiving a clip member or the like attached to said one end of said retaining string or the like to couple said retaining string or the like to said device.

7. The device according to claim 2 wherein said first, second and third tab members are substantially coplanar and said third tab member is substantially centrally located relative to said first and second tab members to define a substantially T-shaped device.

8. The device according to claim 7 wherein the corresponding transition between the third tab member and each of the first and second tab members defines a corresponding curved edge.

9. A device for securing headwear on a user's head, said headwear having a crown portion for receiving the user's head, a flexible band around the inside of the crown portion for contacting the user's head and a brim portion surrounding the crown portion, said device being comprised of:

headwear retaining means for being wrapped around at least a portion of the user's head; and first and second attachment means coupled to respective first and second ends of the retaining means, said first attachment means for engaging the band to secure the device relative to the crown portion of the headwear, said band being attached to the crown portion by a plurality of stitches spaced at predetermined intervals around the inside of said crown portion, said first attachment means for being inserted between adjacent ones of said stitches so that a first portion of said first attachment means is disposed between the band and crown portion and a second portion of said first attachment means extends below said band.

10. The device according to claim 9 wherein said retaining means is comprised of first and second retaining strings and each of said first and second attachment means is comprised of first, second and third relatively flat tab members, said first and second tab members being oriented along a common axis and said third tab member being oriented along an axis substantially orthogonal relative to said common axis of said first and second tab members, the third tab members of said first and second means being coupled to respective first and second ends of the first and second retaining strings.

11. The device according to claim 10 wherein said third tab members are adapted for being inserted between adjacent ones of said stitches so that said third tab members are disposed between said band and the inside of said crown portion and a portion of said third tab member extends below said band when said first and second attachment means engage said band.

12. The device according to claim 11 wherein said first and second tab members engage adjacent ones of said stitches to prevent said device from being disengaged from between said band and said crown portion by movement along the respective axes of said third tab members in a direction toward the exterior of said crown portion, the coupling between the third tab members and the respective retaining strings for preventing said device from being disengaged from between said band and said crown portion by movement along the respective axes of the third tab members in a direction toward the interior of said crown portion.

13. The device according to claim 12 further including first and second clip members for coupling the third tab members to the respective retaining strings.

14. Headwear comprising:

a hat having a crown portion for receiving a user's head, a flexible band around the inside of the crown portion for contacting the user's head and a brim portion surrounding the crown portion;

first and second attachment means, said first attachment means for engaging the hat band at a predetermined position relative to the crown portion of the hat, said band being attached to the crown portion by a plurality of stitches spaced at predetermined intervals around the inside of said crown portion, said first attachment means being adapted for being inserted between adjacent ones of said stitches such that a first portion of the first attachment means is disposed between the band and the inside of the crown portion and a second portion of said first attachment means extends below said band; and retaining means, respective first and second ends of which are coupled to the respective first and second attachment means, so that said retaining means can envelope at least a portion of the user's head to retain the headwear on the user's head.

15. The headwear according to claim 14 wherein each of said first and second attachment means is comprised of first and second relatively flat tab members which are oriented along a common axis and a third relatively flat tab member which is oriented along an axis substantially orthogonal relative to the common axis of said first and second tab members.

16. The headwear according to claim 15 wherein said retaining means is comprised of first and second retaining strings, respective first and second ends of which are attached to the respective third tab members of said first and second attachment means.

17. The headwear according to claim 16 wherein said third tab members are inserted between adjacent ones of said stitches so that said third tab members are disposed between said band and the inside of said crown portion at said respective first and second positions and respective portions of said third tab members extend below said band, the respective first and second tab members for engaging adjacent ones of said stitches to prevent said first and second attachment means from being disengaged from between said band and said crown portion by movement along the axis of the respective third tab members in a direction toward the exterior of the crown portion, the coupling between the third tab members and the corresponding retaining strings for preventing the first and second attachment means from being disengaged from between the band and the crown portion by movement along the axes of the respective third tab members in a direction toward the interior of said crown portion.

18. The headwear according to claim 17 further including first and second clip members coupled between respective first and second ends of said first and second retaining strings and the respective third tab members of said first and second attachment means to connect the respective first and second retaining strings to the first and second attachment means.

19. The headwear according to claim 18 further including an adjustment member for adjusting said first and second retaining strings to conform to the size and shape of the user's head.

20. A method of attaching a retaining string or the like to headwear having a crown portion for receiving the user's head, a flexible band around the inside of the crown portion for contacting the user's head and a brim portion surrounding the crown portion, said method being comprised of the following steps:

providing an attachment device having first means for engaging the band and second means connected to the first means for being coupled to the retaining string or the like;

positioning the device so that at least a portion of the first means is positioned between the band and the inside of said crown portion and at least a portion of said second means extends below said band, said band being attached to the crown portion by a plurality of stitches spaced at predetermined intervals around the inside of said crown portion, said step of positioning said device including the step of inserting said second means between adjacent ones of said stitches so that a portion of said second means which is distally disposed relative to said first means extends below said band and said first means engages said adjacent ones of said stitches to prevent said device from being disengaged from between said band and said crown portion by movement along a predetermined axis in a direction toward the exterior of said crown portion, the coupling between the retaining string and the portion of said second means which extends below said band for preventing said device from being disengaged from between said band and said crown portion by movement along said predetermined axis in a direction toward the interior of said crown portion; and attaching said retaining string or the like to the portion of the second means which extends below said band to attach said retaining string or the like to said headwear.

* * * * *